US012246893B1

(12) United States Patent
Schuver

(10) Patent No.: US 12,246,893 B1
(45) Date of Patent: Mar. 11, 2025

(54) CLOSURE FOR A BEVERAGE CAN LID

(71) Applicant: SBH, Inc., St. Louis, MO (US)

(72) Inventor: Steven S. Schuver, St. Louis, MO (US)

(73) Assignee: SBH, Inc., Saint Louis, MO (US)

( * ) Notice: Subject to any disclaimer, the term of this patent is extended or adjusted under 35 U.S.C. 154(b) by 48 days.

(21) Appl. No.: 18/236,758

(22) Filed: Aug. 22, 2023

(51) Int. Cl.
*B65D 51/00* (2006.01)

(52) U.S. Cl.
CPC .... *B65D 51/007* (2013.01); *B65D 2517/0041* (2013.01)

(58) Field of Classification Search
CPC ..... A47G 19/2211; A47G 19/2216; B65D 51/007; B65D 51/02; B65D 2517/0004; B65D 1/32; B65D 7/04; B65D 15/02; B65D 17/02; B65D 17/523
See application file for complete search history.

(56) References Cited

U.S. PATENT DOCUMENTS 3,805,989 A 4/1974 Walker
3,967,752 A 7/1976 Cudzik
4,433,792 A 2/1984 Mandel
4,842,159 A * 6/1989 Heidrich ..... B65D 51/007 220/714
4,887,712 A 12/1989 Wells
5,285,924 A * 2/1994 Morris ..... B65D 17/4014 220/729
5,351,853 A * 10/1994 Shock ..... B65D 51/007 220/729
5,452,818 A 9/1995 Yost
5,813,559 A * 9/1998 Cho ..... B65D 17/4014 220/269
6,032,816 A * 3/2000 Martin ..... B65D 51/007 220/284
6,158,608 A * 12/2000 Schlattl ..... C23D 5/02 220/253
6,626,314 B1 * 9/2003 McHenry ..... B65D 47/265 220/255
9,315,305 B2 4/2016 Robinson
2004/0256388 A1 12/2004 Rossetti et al.
2011/0232423 A1 * 9/2011 Raymond ..... B65D 51/007 81/3.55
2013/0087563 A1 4/2013 Brandtner
2020/0299055 A1 9/2020 Ritzenhoff
2020/0307856 A1 10/2020 Pawezka
2022/0089319 A1 3/2022 Schuver

* cited by examiner

*Primary Examiner* — Kareen K Thomas
(74) *Attorney, Agent, or Firm* — David H. Chervitz

(57) ABSTRACT

A closure for a beverage can lid has a body having a back end, a front end, a front panel portion, a rear panel portion, and a step down section between the front panel portion and the rear panel portion, a left edge, and a right edge, the back end having a track portion, the front end having a left ear section having a left front edge, a central rounded recess, and a right ear section having a right front edge.

20 Claims, 6 Drawing Sheets

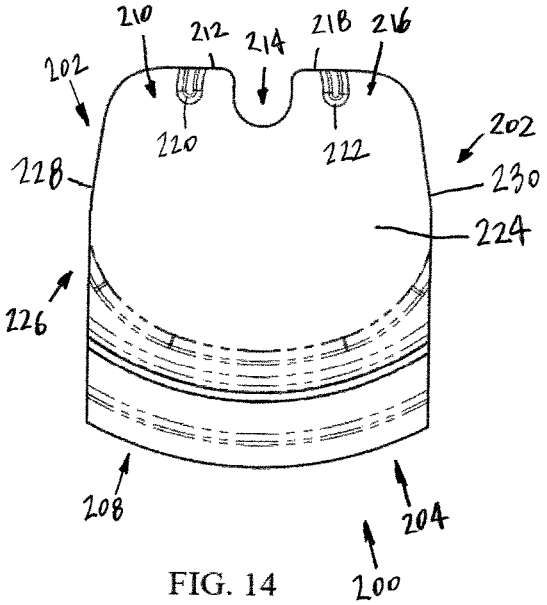
FIG. 14
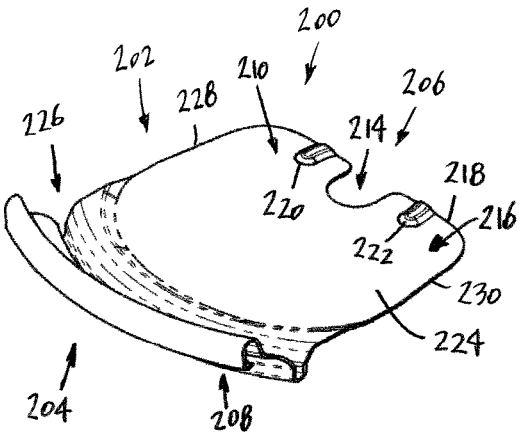
FIG. 13
FIG. 15
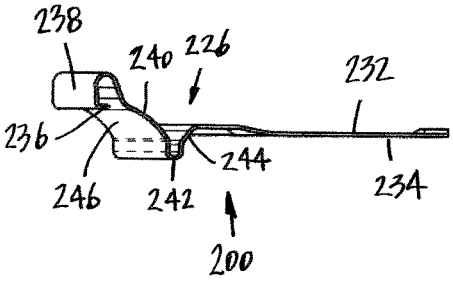

CLOSURE FOR A BEVERAGE CAN LID

BACKGROUND

This disclosure relates generally to a closure for a beverage can lid having an opening, and more particularly to a closure for a beverage can lid for covering the opening.

Beverage cans for containing liquids such as carbonated beverages have become a universal and ubiquitous product. The beverage can is typically constructed of an aluminum alloy composition that may include aluminum, magnesium, manganese, silicon, and copper. The beverage can consists of a can body into which a liquid is filled and a can lid or end that is sealed to the can body. The can body may include a base or bottom that is dome shaped to resist internal pressure, a generally cylindrical section, a narrowed neck portion, and an open top edge. The can lid may include the lid portion that is about the same circumference as the narrowed neck portion of the can body, a scored line or weakened portion cut into the lid portion to form a panel or a tear panel having a hinge, a tab portion that is used to rupture the lid portion along the scored line to create an opening, a rivet that is used to secure the tab to the lid portion, and various strengthening features such as a teardrop or figure eight. The rivet is an integral piece of the lid portion and is formed by stretching the center of the lid portion upwardly and then drawn to form the rivet. The lid is sealed to the can body by trimming the open top edge of the can body, bending the trimmed edge, and seaming the bent trimmed edge to the lid. In this manner, any liquid contained within the can body is sealed. To open the beverage can the tab is lifted to press against the tear panel to partially push the tear panel into the can body to create the opening in the lid. The panel does not fully detach from the lid due to the hinge formed in the lid by ends of the score line. Once opened, liquid from inside the can body may flow through the opening.

One problem associated with the use of the beverage can is that once opened it cannot be closed again. Since the liquid within the beverage can may be carbonated, after a period of time the carbonation escapes and the liquid becomes flat or stale. Once flat, the beverage can and its contents may be discarded which may be wasteful. Also, after opening the beverage can the contents may have to be consumed quickly because the contents cannot be preserved. Further, it is also possible that the contents of the beverage can may spill due to not being able to close the opening. In particular, when an individual is walking with an opened beverage can the individual may trip or fall and the contents of the can may be spilled because the can is open. This may also be problematic if the beverage can is stationary and near electrical equipment such as a computer or a laptop and the can is accidentally knocked over. It is also possible that insects, contaminants, or other unwanted matter may infiltrate the beverage can through the opening. If this occurs, then the beverage can and its contents should be thrown away, discarded, or recycled.

The present disclosure is designed to obviate and overcome many of the disadvantages and shortcomings experienced with prior beverage can constructions. Particularly, it would be advantageous to be able to have a closure for a beverage can lid for preserving the contents of the beverage can. Moreover, the present disclosure is related to a closure for a beverage can lid that can be used to reseal the beverage can for later use, to prevent spillage, or to prevent contaminants from entering the can once opened.

SUMMARY

In one form of the present disclosure, a closure for a beverage can lid is disclosed which comprises a body having a back end, a front end, a front panel portion, a rear panel portion, and a step down section between the front panel portion and the rear panel portion, a left edge, and a right edge, the back end having a track portion, the front end having a left ear section having a left front edge, a central rounded recess, and a right ear section having a right front edge.

In another form of the present disclosure, a closure for a beverage can lid comprises a body having a back end, a front end, a front panel portion, a rear panel portion, and a step down section between the front panel portion and the rear panel portion, a left edge, and a right edge, the back end having a curved track portion, the front end having a left ear section having a left front edge, a central rounded recess, and a right ear section having a right front edge, a left rib portion positioned on the left ear section, and a right rib portion positioned on the right ear section.

In still another form of the present disclosure, a closure for a beverage can lid comprises a body having a back end, a front end, a front panel portion, a rear panel portion, and a step down section between the front panel portion and the rear panel portion, a left edge, and a right edge, the back end having a track portion having a lower lip portion, a generally inverted U-shaped portion, an arched segment, a generally U-shaped portion, and an angled segment, the front end having a left ear section having a left front edge, a central rounded recess, and a right ear section having a right front edge, a left rib portion positioned on the left ear section, and a right rib portion positioned on the right ear section.

In light of the foregoing comments, it will be recognized that the closure for a beverage can lid of the present disclosure is of simple construction and design and which can be easily employed with highly reliable results.

The present disclosure provides a closure for a beverage can lid that may be used to reseal an opened beverage can to preserve the contents of the beverage can for later use.

The present disclosure provides a closure for a beverage can lid that employs an easy to use closure mechanism that allows an individual to reseal the lid of an opened beverage can.

The present disclosure is directed to a closure for a beverage can lid that is hygienic and provides a sanitary closure mechanism.

The present disclosure provides a closure for a beverage can lid that does not require any special tools to close or open the beverage can lid.

The present disclosure also provides a closure for a beverage can lid that can be used with any sized beverage can.

The present disclosure provides a closure for a beverage can lid that can be constructed using readily available materials and construction techniques and machinery.

The present disclosure also provides a closure for a beverage can lid having a closure mechanism that may be added to a beverage can after the beverage can has been manufactured.

The present disclosure is also directed to a closure for a beverage can lid that can be used to open and close the lid of an opened beverage can several times.

The present disclosure is also directed to a closure for a beverage can lid that does not interfere with the operation of a tab connected to the beverage can lid.

The present disclosure is further directed to a closure for a beverage can lid that can be moved from an opened position to a closed position to reseal the beverage can lid.

The present disclosure also provides a closure for a beverage can lid that may be constructed of a thinner metal than the beverage can lid.

These and other advantages of the present disclosure will become apparent after considering the following detailed specification in conjunction with the accompanying drawings, wherein:

BRIEF DESCRIPTION OF THE DRAWINGS

FIG. 13 is a perspective view of another embodiment of a closure for a beverage can lid constructed according to the present disclosure;

FIG. 14 is a top view of the closure for a beverage can lid shown in FIG. 13; and FIG. 15 is a side view of the closure for a beverage can lid shown in FIG. 13.

DETAILED DESCRIPTION OF A PREFERRED EMBODIMENT

Figure 2:
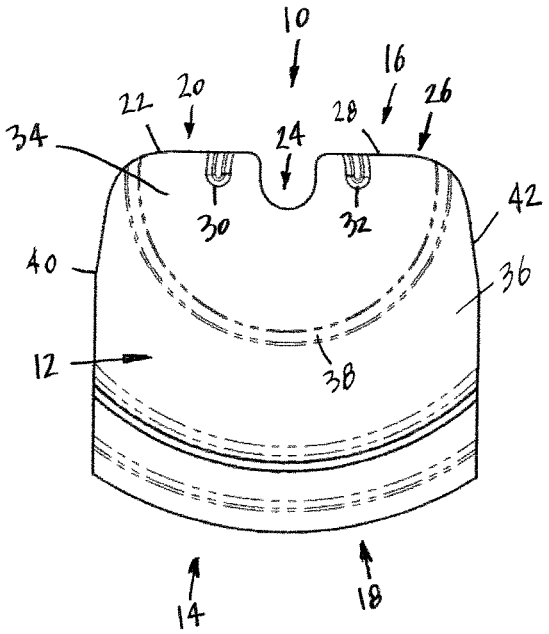
FIG. 2 is a top view of the closure for a beverage can lid shown in FIG. 1.
Figure 1:
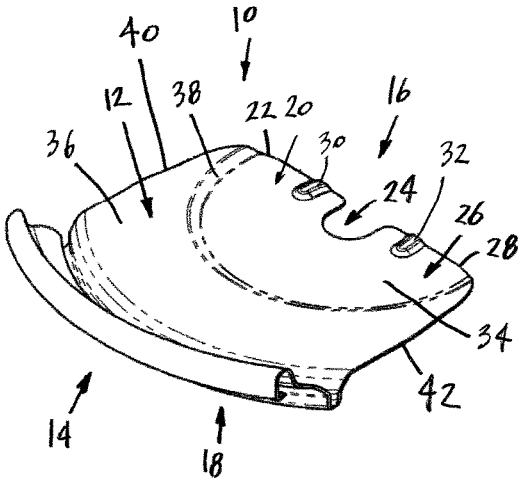
FIG. 1 is a perspective view of a closure for a beverage can lid constructed according to the present disclosure.

Referring now to the drawings, wherein like numbers refer to like items, number 10 identifies a preferred embodiment of a closure for a beverage can lid constructed according to the present disclosure. Referring now to FIGS. 1 and 2, the closure 10 is shown to comprise a body 12 having a back end 14 and a front end 16. The back end 14 has a track portion 18 that is used to ride, slide, or move along a rim (not shown) of a beverage can lid (not shown). The front end 16 has a first or left tooth or ear section 20 having a left front edge 22, a central rounded recess or slot 24, and a second or right tooth or ear section 26 having a right front edge 28. The first section 20 has a left nub or rib portion 30 at the left front edge 22 and the second portion 26 has a right nub or rib portion 32 at the right front edge 28. The rib portions 30 and 32 are shorter than the central rounded recess 24. Although the rib portions 30 and 32 are shown it is possible that the closure 10 may not require the rib portions 30 and 32. The body 12 also has a front panel portion 34, a rear panel portion 36, and a step down section 38 between the front panel portion 34 and the rear panel portion 36, a left edge 40, and a right edge 42. The step down section 38 is curved or arcuate in shape and spans from the left front edge 22 to the right front edge 28. The track portion 18 is also curved or arcuate in shape and is adapted to fit around a rim (not shown), as will be described in further detail herein.

Figure 3:
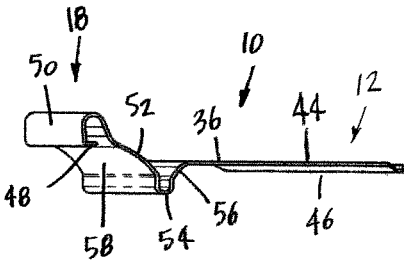
FIG. 3 is a side view of the closure for a beverage can lid shown in FIG. 1.

FIG. 3 shows a side perspective of the closure for a beverage can lid 10 constructed according to the present disclosure. The closure 10 has the body 12 having a top surface 44 and a bottom surface 46. The bottom surface 46 is adapted to engage with or cover a beverage can lid (not shown). The track portion 18 has a lower lip portion 48 and a generally inverted U-shaped portion 50. The U-shaped portion 50 continues to an arched segment 52 and a generally U-shaped portion 54. The generally U-shaped portion 54 continues to an angled segment 56 and to the rear panel portion 36. The track portion 18, the arched segment 52, and the generally U-shaped portion 54 have a bottom surface 58 that is adapted to engage with or cover a rim (not shown) of a beverage can (not shown). The closure 10 is of unitary construction in that the body 12, the track portion 18, the arched segment 52, the generally U-shaped portion 54, and the angled segment 56 are formed from one piece of material.

Figure 5:
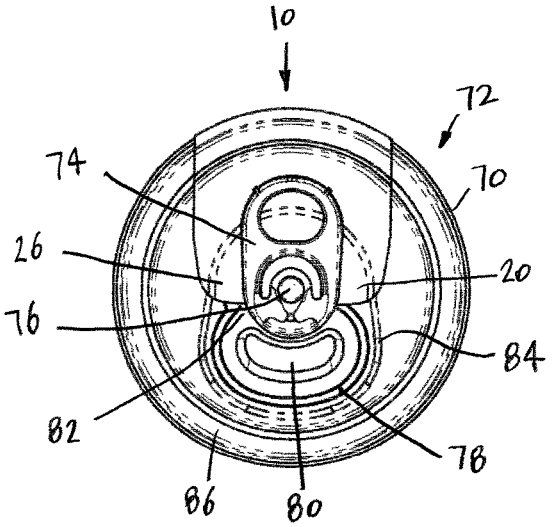
FIG. 5 is a top view of the closure for a beverage can lid constructed according to the present disclosure with the closure in an initial position and the beverage can lid unopened.
Figure 4:
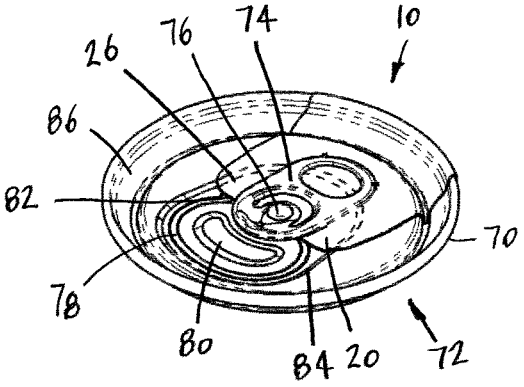
FIG. 4 is a perspective view of the closure for a beverage can lid constructed according to the present disclosure with the closure in an initial position and the beverage can lid unopened.

With reference now to FIGS. 4 and 5, the closure 10 is illustrated being positioned on a rim 70 of a beverage can lid 72. The beverage can lid 72 has a tab 74 that is staked to a rivet 76. A score line 78 is formed in the beverage can lid 72 which defines a tear panel 80. The tear panel 80 is adapted to be partially detached from the beverage can lid 72 and is held to the beverage can lid 72 by use of a hinge 82. The beverage can lid 72 also has an indented area 84 with such indented area 84 being in the shape of a teardrop or a figure eight. In operation, the tab 74 is lifted to press into the tear panel 80 to open the beverage can lid 72 by rupturing the tear panel 80 along the score line 78. Once opened, the contents of a beverage can (not shown) may be removed through an opening (not shown) formed by partially detaching the tear panel 80. The closure 10 is shown being in an initial position in which the beverage can lid 72 is not opened and the closure 10 is not covering the tear panel 80. Although the initial position is depicted in FIGS. 4 and 5 as being at the 12 o'clock position it is possible and contemplated that the initial position may be at any location around the rim 70. In the initial position the closure 10 is not preventing the tab 74 from being lifted or used. The closure 10 is positioned on the rim 70 and is capable of moving or sliding along the rim 70 to move the closure 10 from the initial position. The body 12 of the closure 10 is positioned below the tab 74 with the left ear section 20 and the right ear section 26 being underneath the tab 74. Although hidden in these particular views, the central rounded recess 24 fits around the rivet 76. The rim 70 also has a surface 86 against which the bottom surface 58 (FIG. 3) of the closure 10 slides upon during use. As can be appreciated, the shape of the track portion 18 (FIGS. 1, 2, and 3) is similar to the shape of the rim 70 and the shape of the U-shaped portion 50, the arched segment 52, and the generally U-shaped portion 54 are similar to the shape of the surface 86. This allows the closure 10 to easily slide along the rim 70.

Figure 7:
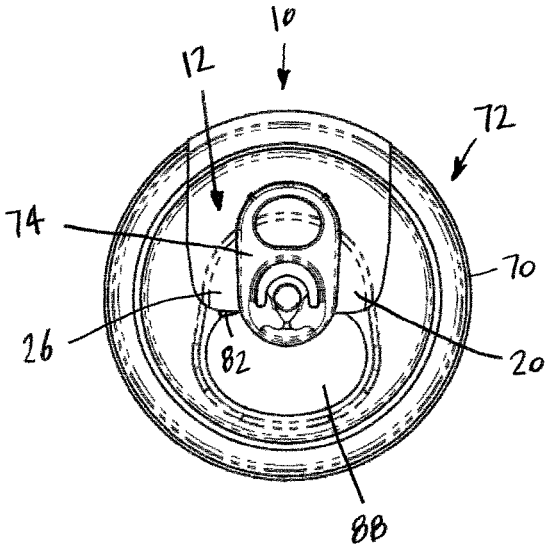
FIG. 7 is a top view of the closure for a beverage can lid constructed according to the present disclosure with the closure in an initial position and the beverage can lid opened.
Figure 6:
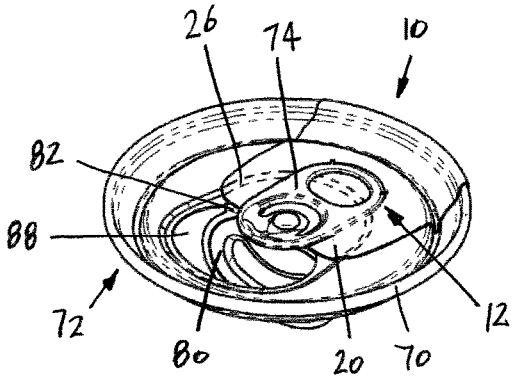
FIG. 6 is a perspective view of the closure for a beverage can lid constructed according to the present disclosure with the closure in an initial position and the beverage can lid opened.

FIGS. 6 and 7 depict the beverage can lid 72 being opened and the closure 10 being in the initial position. In this configuration, the tab 74 has been used to rupture or detach the tear panel 80 to form an opening 88 in the beverage can lid 72. The closure 10 has not interfered with the operation of the tab 74. The tear panel 80 is held to the beverage can lid 72 by use of the hinge 82. In this manner, the tear panel 80 will not fall into a beverage can (not shown) attached to the beverage can lid 72. The closure 10 is positioned on the rim 70 and is capable of moving or sliding along the rim 70 to move the closure 10 from the initial position. The body 12 of the closure 10 is positioned below the tab 74 with the left ear section 20 and the right ear section 26 being underneath the tab 74.

Figure 9:
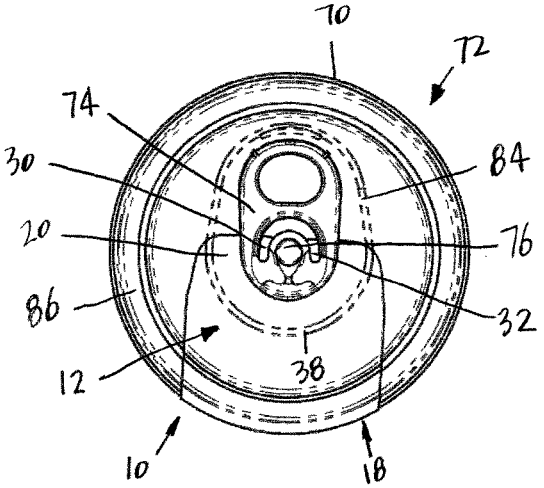
FIG. 9 is a top view of the closure for a beverage can lid constructed according to the present disclosure with the closure in a closed position and the beverage can lid opening or unopened.
Figure 8:
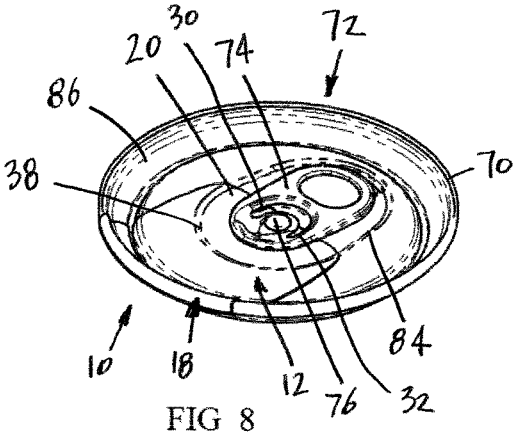
FIG. 8 is a perspective view of the closure for a beverage can lid constructed according to the present disclosure with the closure in a closed position and the beverage can lid opened or unopened.

Referring now to FIGS. 8 and 9, the closure 10 is shown in a closed position covering either the tear panel 80 (FIGS. 4 and 5) when the beverage can lid 72 (FIGS. 4 and 5) has not been opened or the opening 88 (FIGS. 6 and 7) when the beverage can lid 72 (FIGS. 6 and 7) has been opened. The closure 10 has been moved or rotated about the rivet 76 by use of the central rounded recess 24 (FIGS. 1 and 2) from the initial position to the closed position by sliding or moving the track portion 18 along the rim 70. The body 12 completely covers the tear panel 80 or the opening 88 and is below or beneath the tab 74. The step down section 38 also rides within the indented area 84 which ensures that the body 12 remains flat or tight against the beverage can lid 72. Due to the left tooth section 20 the hinge 82 (FIGS. 4, 5, 6, and 7) is also covered to prevent any leaking of fluid from the beverage can (not shown) when the closure 10 is in the closed position. The rib portions 30 and 32 are also used to hold the tab 74 in place. The rib portions 30 and 32 are further used to move the tab 74 so that the cover 10 can freely rotate or slide. As has been described above, the shape of the track portion 18 (FIGS. 1, 2, and 3) is similar to the shape of the rim 70 and the shape of the U-shaped portion 50, the arched segment 52, and the generally U-shaped portion 54, all of which are shown in FIG. 3, are formed to be similar to the shape of the surface 86. This allows the closure 10 to easily slide or ride along the rim 70.

The operation of the closure 10 may be as follows with reference to FIGS. 1-9. A beverage can body is filled with a beverage and the beverage can lid 72 is sealed to the beverage can body to form the rim 70 by a seaming operation to construct a beverage can. Once the beverage can is manufactured the closure 10 may be positioned on the rim 70 of the beverage can by inserting the front end 16 underneath the tab 74 and placing the track portion 18 over the rim 72. The closure 10 is then moved to the initial position. The tab 74 is lifted to rupture the tear panel 80 along the score line 78. The tear panel 80 is partially detached or separated from the beverage can lid 72 to form the opening 88 and any beverage inside the beverage can may be removed through the opening 88. When an individual wants to cover or seal the opening 88 the closure 10 is moved from the initial position to the closed position to fully cover the opening 88. When the individual wants to again drink from the beverage can the closure may be moved from the closed position to the initial position. The beverage can may be held, stored, or refrigerated without concern that the beverage will spill out of the beverage can or that the beverage will become stale or that the beverage will be contaminated. As is known, once the beverage from the beverage can has been consumed, the beverage can and the closure 10 may be recycled.

Figure 11:
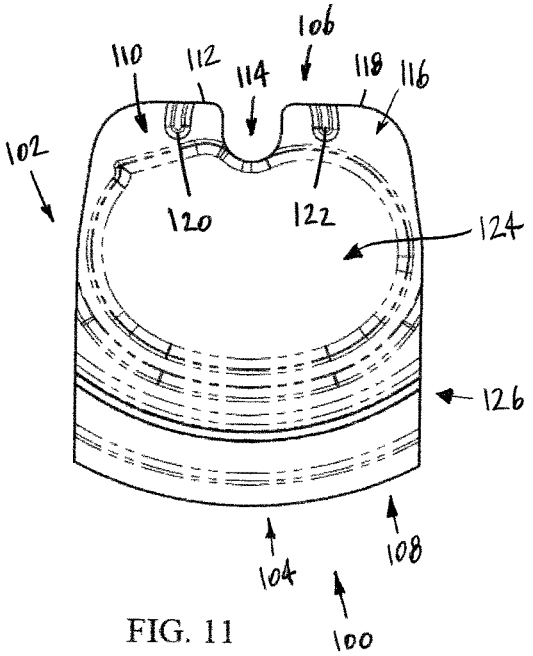
FIG. 11 is a top view of the closure for a beverage can lid shown in FIG. 10.
Figure 10:
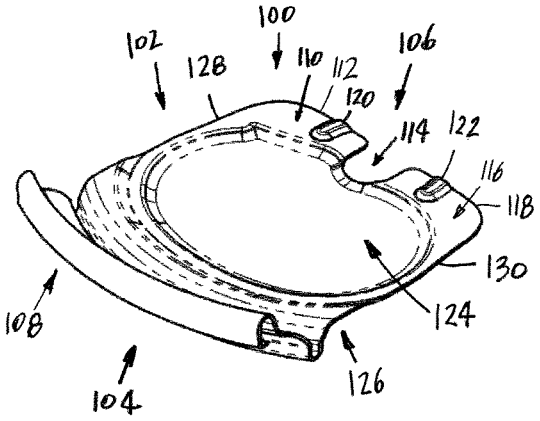
FIG. 10 is a perspective view of another embodiment of a closure for a beverage can lid constructed according to the present disclosure.

FIGS. 10 and 11 illustrated another embodiment of a closure for a beverage can lid 100 constructed according to the present disclosure. The closure 100 is shown to comprise a body 102 having a back end 104 and a front end 106. The back end 104 has a track portion 108 that is used to ride, slide, or move along a rim (not shown) of a beverage can lid (not shown). The front end 106 has a first or left tooth or ear section 110 having a left front edge 112, a central rounded recess or slot 114, and a second or right tooth or ear section 116 having a right front edge 118. The first section 110 has a left nub or rib portion 120 and the second portion 116 has a right nub or rib portion 122. The rib portions 120 and 122 are shorter than the central rounded recess 114. The body 102 also has an indented panel portion 124, a rear panel portion 126, a left edge 128, and a right edge 130. The indented panel portion 124 is adapted to fit within an opening, such as the opening 88 (FIGS. 6 and 7). The track portion 108 is curved or arcuate in shape and is adapted to fit around a rim (not shown).

Figure 12:
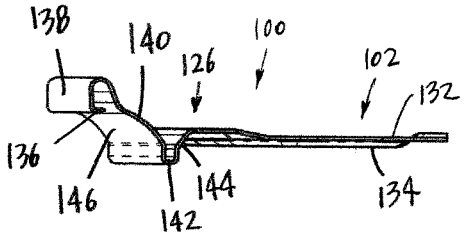
FIG. 12 is a side view of the closure for a beverage can lid shown in FIG. 10.

Referring now in particular to FIG. 12, a side perspective of the closure for a beverage can lid 100 constructed according to the present disclosure is shown. The closure 100 has the body 102 having a top surface 132 and a bottom surface 134. The bottom surface 134 is adapted to engage with or cover a beverage can lid (not shown). The track portion 108 has a lower lip portion 136 and a generally inverted U-shaped portion 138. The U-shaped portion 138 continues to an arched segment 140 and a generally U-shaped portion 142. The generally U-shaped portion 142 continues to an angled segment 144 and to the rear panel portion 126. The track portion 108, the arched segment 140, and the generally U-shaped portion 142 have a bottom surface 146 that is adapted to engage with or cover a rim (not shown) of a beverage can (not shown). The closure 100 is of unitary construction in that the body 102, the track portion 108, the arched segment 140, the generally U-shaped portion 142, and the angled segment 144 are formed from one piece of material.

With reference now to FIGS. 13 and 14 another embodiment of a closure for a beverage can lid 200 constructed according to the present disclosure is shown. The closure 200 comprises a body 202 having a back end 204 and a front end 206. The back end 204 has a track portion 208 that is used to ride, slide, or move along a rim (not shown) of a beverage can lid (not shown). The front end 206 has a first or left tooth or ear section 210 having a left front edge 212, a central rounded recess or slot 214, and a second or right tooth or ear section 216 having a right front edge 218. The first section 210 has a left nub or rib portion 220 and the second portion 216 has a right nub or rib portion 222. The rib portions 220 and 222 are shorter than the central rounded recess 214. The body 202 also has a flat front panel portion 224, a rear panel portion 226, a left edge 228, and a right edge 230. The flat front panel portion 224 is adapted to fit within an opening, such as the opening 88 (FIGS. 6 and 7). The track portion 208 is curved or arcuate in shape and is adapted to fit around a rim (not shown).

FIG. 15 depicts a side perspective of the closure for a beverage can lid 200 constructed according to the present disclosure. The closure 200 has the body 202 having a top surface 232 and a bottom surface 234. The bottom surface 234 is adapted to engage with or cover a beverage can lid (not shown). The track portion 208 has a lower lip portion 236 and a generally inverted U-shaped portion 238. The U-shaped portion 238 continues to an arched segment 240 and a generally U-shaped portion 242. The generally U-shaped portion 242 continues to an angled segment 244 and to the rear panel portion 226. The track portion 208, the arched segment 240, and the generally U-shaped portion 242 have a bottom surface 246 that is adapted to engage with or cover a rim (not shown) of a beverage can (not shown). The closure 200 is of unitary construction in that the body 202, the track portion 208, the arched segment 240, the generally U-shaped portion 242, and the angled segment 244 are formed from one piece of material.

Preferably, the closures for a beverage can lid 10, 100, and 200 will be constructed of a relatively lightweight material so that it can be easily used and manufactured. By way of example only, the closures 10, 100, and 200 may be constructed of aluminum or an aluminum alloy. Further, the closures for a beverage can lid 10, 100, and 200 may have a thickness with such thickness be less that the thickness of a beverage can lid. This may lead to the closures for a beverage can lid 10, 100, and 200 costing less than the beverage can lid to manufacture.

Although it has been indicated herein that the closures for a beverage can lid 10, 100, and 200 are used with cans that contain a liquid, such as a carbonated beverage, it is also possible and contemplated that the cans may contain other items such as non-carbonated beverages, powders, spices, foods, syrups, gums, candies, or any other item that can be removed from an opening in the lids and may need to be resealed or closed.

From all that has been said, it will be clear that there has thus been shown and described herein a closure for a beverage can lid which fulfills the various objects and advantages sought therefor. It will be apparent to those skilled in the art, however, that many changes, modifications, variations, and other uses and applications of the subject closure for a beverage can lid are possible and contemplated. All changes, modifications, variations, and other uses and applications which do not depart from the spirit and scope of the disclosure are deemed to be covered by the disclosure, which is limited only by the claims which follow.

What is claimed is:

1. A closure for a beverage can lid comprising:

a body having a back end, a front end, a front panel portion, a rear panel portion, and a curved step down section between the front panel portion and the rear panel portion, a left edge, and a right edge, the back end having a track portion, the front end having a left ear section having a left front edge, a central rounded recess, and a right ear section having a right front edge, and the step down section spans from the left front edge to the right front edge.

2. The closure for a beverage can lid of claim 1 wherein the central rounded recess is between the left ear section and the right ear section.

3. The closure for a beverage can lid of claim 1 wherein the track portion has a lower lip portion.

4. The closure for a beverage can lid of claim 1 wherein the track portion has a generally inverted U-shaped portion.

5. The closure for a beverage can lid of claim 1 wherein the track portion has a lower lip portion with the lower lip portion being curved.

6. The closure for a beverage can lid of claim 1 wherein the track portion has a generally inverted U-shaped portion with the generally U-shaped portion being curved.

7. The closure for a beverage can lid of claim 1 wherein the track portion has a lower lip portion and a generally inverted U-shaped portion.

8. A closure for a beverage can lid comprising:

a body having a back end, a front end, a front panel portion, a rear panel portion, and a step down section between the front panel portion and the rear panel portion, a left edge, and a right edge, the back end having a curved track portion, the front end having a left ear section having a left front edge, a central rounded recess, and a right ear section having a right front edge;

a left rib portion positioned on the left ear section; and a right rib portion positioned on the right ear section.

9. The closure for a beverage can lid of claim 8 wherein the left rib portion is shorter than the central rounded recess.

10. The closure for a beverage can lid of claim 8 wherein the right rib portion is shorter than the central rounded recess.

11. The closure for a beverage can lid of claim 8 wherein the step down portion spans from the left front edge to the right front edge.

12. The closure for a beverage can lid of claim 8 wherein the step down portion curves from the left front edge to the right front edge.

13. The closure for a beverage can lid of claim 8 wherein the track portion has a lower lip portion and a generally inverted U-shaped portion.

14. The closure for a beverage can lid of claim 8 wherein the central rounded recess is between the left ear section and the right ear section.

15. A closure for a beverage can lid comprising:

a body having a back end, a front end, a front panel portion, a rear panel portion, and a step down section between the front panel portion and the rear panel portion, a left edge, and a right edge, the back end having a track portion having a lower lip portion, a generally inverted U-shaped portion, an arched segment, a generally U-shaped portion, and an angled segment, the front end having a left ear section having a left front edge, a central rounded recess, and a right ear section having a right front edge;

a left rib portion positioned on the left ear section; and a right rib portion positioned on the right ear section.

16. The closure for a beverage can lid of claim 15 wherein the step down portion spans from the left front edge to the right front edge.

17. The closure for a beverage can lid of claim 15 wherein the step down portion curves from the left front edge to the right front edge.

18. The closure for a beverage can lid of claim 15 wherein the left rib portion is shorter than the central rounded recess.

19. The closure for a beverage can lid of claim 15 wherein the right rib portion is shorter than the central rounded recess.

20. The closure for a beverage can lid of claim 15 wherein the central rounded recess is between the left ear section and the right ear section.

* * * * *